US005433166A

United States Patent [19]

Donatello et al.

[11] Patent Number: 5,433,166

[45] Date of Patent: Jul. 18, 1995

[54] RAILWAY LIGHT SIGNAL

[75] Inventors: David A. Donatello, Rush; Kenton H. Barker, Penfield; Ronald W. Dinger; James M. Martin, both of Rochester, all of N.Y.

[73] Assignee: General Railway Signal Corporation, Rochester, N.Y.

[21] Appl. No.: 242,025

[22] Filed: May 12, 1994

Related U.S. Application Data

[63] Continuation of Ser. No. 960,525, Oct. 13, 1992, abandoned.

[51] Int. Cl.[6] ..... B61L 29/24; F21V 21/00

[52] U.S. Cl. ..... 116/202; 246/473.3; 362/268; 362/382

[58] Field of Search ..... 116/63 R, 202; 246/473.3; 362/268, 382, 455

[56] References Cited

U.S. PATENT DOCUMENTS

| | | | |
|---|---|---|---|
| 1,453,535 | 5/1923 | Wells | 246/473.3 X |
| 1,498,184 | 6/1924 | McCarthy | 246/473.3 X |
| 1,640,170 | 8/1927 | Wright | 116/63 R |
| 1,748,913 | 2/1930 | Day | 246/473.3 |
| 1,876,384 | 9/1932 | Arano | 362/455 X |
| 1,998,678 | 4/1935 | Larson | 246/473.3 |
| 3,219,973 | 11/1965 | Lenz | 362/455 X |
| 3,576,563 | 4/1971 | Scott et al. | 246/473.3 X |

FOREIGN PATENT DOCUMENTS

| | | | |
|---|---|---|---|
| 0366224 | 2/1932 | United Kingdom | 362/268 |

*Primary Examiner*—William A. Cuchlinski, Jr.
*Assistant Examiner*—John L. Beres
*Attorney, Agent, or Firm*—Ohlandt, Greeley, Ruggiero & Perle

[57] ABSTRACT

A light signal provides fixed focus and the ability to service the device solely from the rear. This light signal comprises a housing having a rear entry for desired maintenance and an immovable front wall, the lens mount containing a lens unit that is removable secured to an inside surface of the immovable front wall of the housing. Each lens mount includes a fixed focusing means having a receptacle for operative receipt of a light means, wherein the fixed focusing means is positioned at the end of the lens mount nearest an inner lens; whereby the focus of the light means is fixed relative to the lens unit.

6 Claims, 6 Drawing Sheets

RAILWAY LIGHT SIGNAL

This application is a continuation of application Ser. No. 07/960,525, filed on Oct. 13, 1992, now abandoned.

The present invention relates generally to a railway light signal. More particularly, it relates to an improved railway light signal case and a method of assembling and installing a lens unit in the case. The light signal case permits access to the lens unit through the rear of the case so that the lens unit can be fully serviced or replaced without affecting the front of the light signal. In addition, the light signal and its case provide aspect to aspect alignment in a multiply aspect signal light, as well as fixed focusing of the lens unit.

BACKGROUND OF THE INVENTION

The service and repair of the lens units of a railway light signal have always been a problem in the railway signal industry. Each time a lens unit is serviced the signal must be re-aligned and re-focused before it is re-activated. This is both costly and time consuming. Hence, it would be highly desirable to design a light signal that could be maintained without alignment or focusing thereof.

Some conventional light signals require that the maintainer or maintenance person reach around the background to remove the outer lens components and then the entire lens unit. The problem with this method is that it is very difficult and dangerous to reach around the outer lens components. Furthermore, each installed lens unit needs to be re-focused.

Still other devices require that the maintenance person turn the signal head on the mast to gain access to the outer lens components and thus the entire lens unit. The obvious problem with this approach is that the signal head needs readjustment during servicing which is rather cumbersome and costly.

In most instances a platform must be built in front of the signal case so that the maintenance person can have access to the front of the signal. These platforms require significant amounts of time and money to construct. It would therefore be highly desirable to design a signal device that does not require servicing through the front of the device.

Conventional light signals typically consist of three aspects or lens units that are bolted together within a single case. Thus, whenever a lens unit is being repaired or replaced the entire lens unit must be removed from its scaffolding and returned to a maintenance facility where the individual lenses are re-focused and re-aligned in a dark room. This increases the cost and repair time required for servicing each lens unit.

Many conventional light signal cases also require that the lens units be mounted by means of a series of aluminum rings that sandwich the lens. These rings are bolted to a machined surface on the front of the signal case. In the present light signal, a lens mount, in the form of a ring, is mounted to the machined fixed or immovable inside surface of the case to provide for retention of the lens unit. Accordingly, no access to or through the front of the light signal is required. In other words, in accordance with the present invention, access only from the rear permits removing all significant elements requiring replacement or repair and, hence, obviates the need for a maintenance man to do anything affecting the front of the light signal case.

Many light signals require that the lamp or lamp filament be focused into position at or near the focal point of the lens unit each time the lamp holder or receptacle is assembled into the light signal. The present signal head is constructed so that the filament lamp is automatically positioned close enough to the focal point of the lens unit to provide adequate range and light output and thereby avoid the need for focusing. Accordingly, the time and expense of a focusing procedure and focusing equipment are avoided.

The aforementioned methods are dangerous since they typically require access through the front of the light signal. Still other signals need a platform built thereabout in order to perform simple maintenance procedures or readjustment of the mast head. More importantly, however, the light signal cases discussed above all require re-alignment and/or re-focusing of the lamp and lenses each time maintenance work is done.

Against the foregoing background, the present inventors have designed a novel light signal casing wherein access to each lens unit of the light signal is effected through the rear of the light signal's case. This allows maintenance personnel to replace the lens mount or bezel and/or the outer lens without the need to access the interior of light signal through the front thereof.

It also provides a new light signal in which the case or housing of the light signal provides precise aspect to aspect alignment.

The present invention provides a unique light signal in which lens units are fixed or automatically focused.

The present invention further provides a light signal in which the case is divided into individual lens compartments to ensure accurate indications by avoiding phantom indications and, thereby, assuring proper aspect to aspect alignment.

Furthermore, the present invention provides a light signal in which the case provides strength and weather protection for the components inside the case.

SUMMARY OF THE INVENTION

To the accomplishments of the foregoing objects and advantages, the present invention, in brief summary, comprises a multiple aspect light signal that permits solely rear entry into the interior compartments thereof. It also provides for fixed focusing and automatic aspect to aspect alignment during servicing of the lens mount inner and, outer lens and light bulb. The light signal includes a housing comprising a front wall with at least one aperture contained therein, a top wall, a bottom wall and a rear wall having a rear plate affixed thereto such that the rear door moves from a first position that prohibits access to the interior of the housing to a second position that permits access to the interior of the housing; at least one lens unit which comprises an inner lens and an outer lens; at least one lens mount for receiving the lens unit therein, the lens mount being removably secured to an inside surface of the front wall of the housing; means for securing each lens mount to an inside surface of the front wall, at least one light means. Additionally at least one fixed focusing means can be provided, such means having a receptacle for operative receipt of the light means, the fixed focusing means being positioned at the end of the lens mount nearest the inner lens; whereby of the light means is fixed relative to the lens unit and the aperture.

In one specific embodiment the housing comprises a front wall with three apertures therethrough and a plurality of studs projecting therefrom about each aperture, a top wall, a bottom wall and a pair of interior walls with the interior walls being connected to the front wall to divide the housing into three interior compartments and the front wall of each compartment having a selected inside surface. The light signal also includes a rear door hinged to the housing to move from a closed position to prevent access to the interior of the housing to an open position that permits access to the interior of the housing, three lens units, three lens mounts each for receiving a different one of the three lens units with each lens mount being removably secured to the selected inside surface in a different one of the three interior compartments and means for securing the lens mount to the inside surface. The light signal further includes light means and three fixed focusing means each being positioned on a different one of the three lens mounts. Each focusing means has a receptacle for operative receipt of a portion of the light means and each is positioned on the lens mount so that the light means aligns with the lens unit and the aperture and the light means almost abuts the lens unit thereby providing fixed focus of the lens unit.

The foregoing and still other objects and advantages of the present invention will be more apparent from the following detailed explanation of the preferred embodiments of the present invention in connection with the accompanying drawings.

BRIEF DESCRIPTION OF THE PREFERRED EMBODIMENTS

The rear entry design of the light signal of the present invention allows maintenance personnel to service the interior compartments of the light signal solely from the rear thereof. This avoids the costly and time consuming problems associated with accessing such compartments through the front of the light signal.

This unique light signal design also provides a means for maintaining a fixed focus even after the light bulb, lens mount and/or lens are serviced. Fixed focusing is accomplished by controlling the position of (1) the light bulb relative to the bulb receptacle, (2) the bulb receptacle relative to the L-shaped bracket, (3) the L-shaped bracket relative to the lens mount, (4) the lens mount relative to the inner lens, and (5) the inner lens relative to the outer lens.

The design also provides for automatic aspect to aspect alignment. Precise aspect to aspect alignment is accomplished by controlling parallelism between the machined surfaces for each aspect relative to one another. Better aspect to aspect alignment is accomplished by controlling machining tolerances.

The phantom indications are minimized by incorporating separate compartments for each aspect. This insures that light from the illuminated aspect of one compartment does not leak into the unlit aspects of an adjoining compartment. In addition, phantom indications are minimized through the use of black paint on the interior surfaces of the light signal to insure that light is not reflected into the lens.

Figure 1:
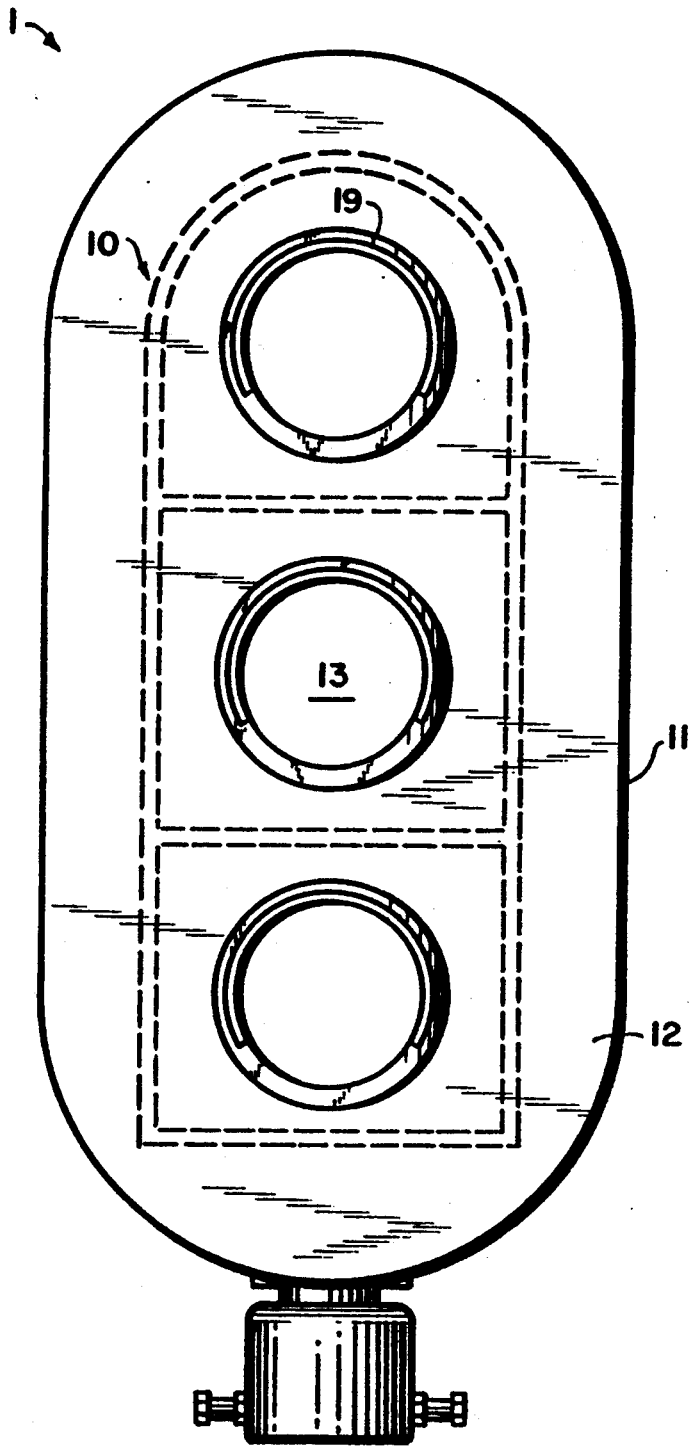
FIG. 1 is a front elevation view of the light signal of the present invention.

Referring to the drawings and, in particular, FIG. 1, there is provided a light signal generally represented by reference numeral 1. The light signal 1 has a case or housing 10 with a front wall 12 and background 11. The front wall 12 has at least one aperture 13 to provide for a lens unit and the light from a lamp to pass therethrough. In the preferred embodiment shown in FIG. 1, the light signal is a three aspect light signal. Accordingly, three apertures 13 are provided in front wall 12. The case 10, preferably, has a hood 19 mounted to or integrally formed on the front wall 12 about a portion of each aperture 13.

Figure 2:
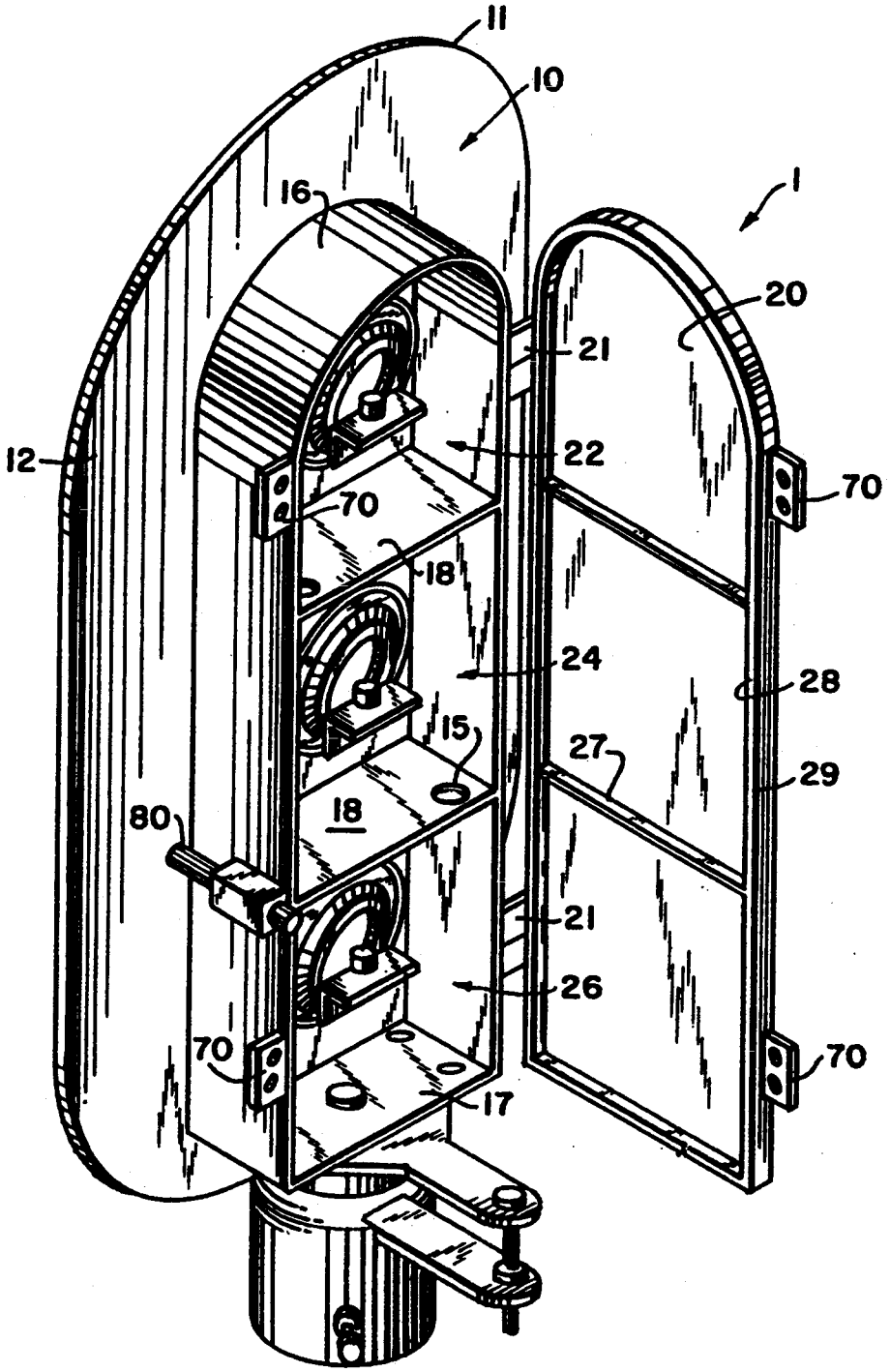
FIG. 2 is a perspective view of the back and a side of the light signal of FIG. 1.

As shown in FIG. 2, the case 10 also includes a movable rear plate or door 20 that provides access to the interior of the case. It is preferred that the door 20 be hinged by hinges 21 to the side of the case 10. When the door 20 is in its closed or operative position, the door is approximately parallel to the front wall 12.

The door 20 is, preferably, made of a one piece aluminum casting. The door 20 has a groove 28 that is adapted to engage the edge of the case 10 and to receive a one piece closed cell rubber gasket 29 that provides a consistent weather tight seal. The gasket 29 is preferably a neoprene gasket that provides long lasting weather tight seal. The door 20 is preferably retained in its closed position by a pair of dual locking screws 70 to insure positive gasket pressure. The door 20 also preferably includes embossments 27 that serve as a further means to prevent light from passing from compartment to compartment.

Figure 3:
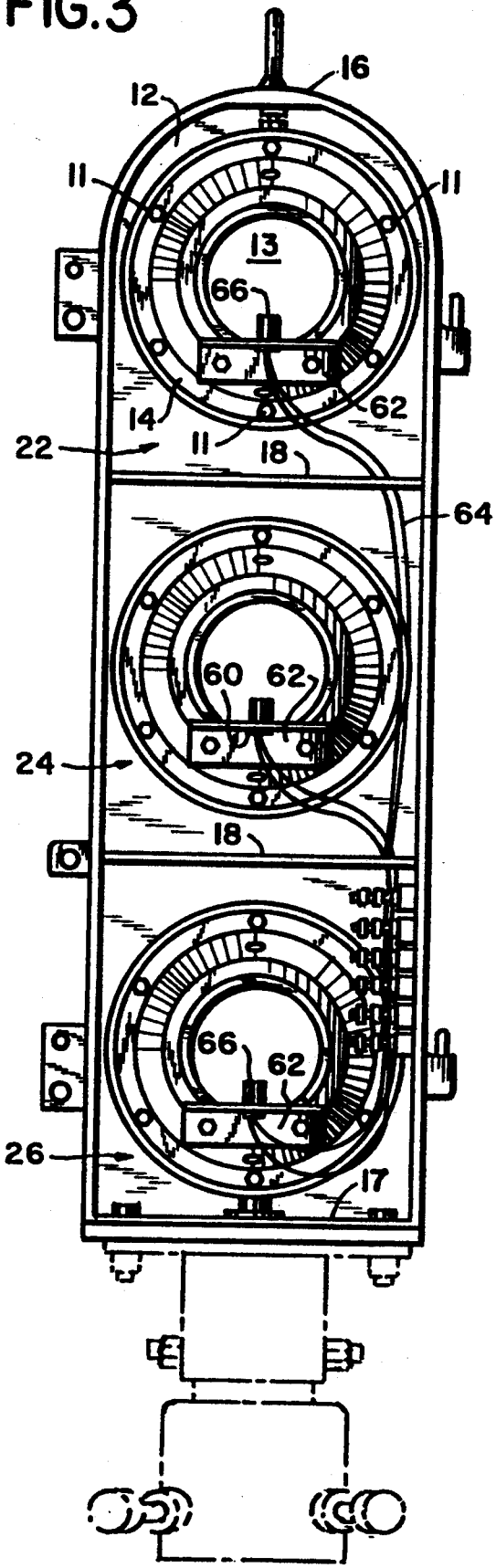
FIG. 3 is a rear planar view of the light signal of FIG. 1.

Referring to FIGS. 2 and 3, the case 10 also includes a top wall 16 that is approximately perpendicular to the front wall, a bottom wall 17 that is approximately parallel to the top wall, and may include, depending on the number of aspects in the light signal, one or more interior walls or surfaces 18 that are approximately parallel to the top and bottom walls.

In a preferred embodiment, the front wall 12, the top wall 16, the bottom wall 17 and the interior walls 18 are integrally formed together to form a one piece case 10. In the most preferred embodiment, the one piece case 10 is made of cast aluminum which is light in weight. This case 10 is preferred since it minimizes the possibility that moisture or foreign elements will enter into the case and, particularly, each compartment. It is possible, however, that the walls of the case 10 can be separately formed provided that are connected together during operation.

A sight or sighting device 80 is positioned on the outside of the case 10. The sight 80 is removably attached to the outside of the case during use by any conventional means. When sight 80 is not in use then it may be stored inside the case.

FIGS. 2 and 3 show the preferred railway light signal 1, namely a three aspect light signal. The three aspect light signal 1 is preferred since it provides for the three colors normally used in a railway signal light, namely green (i.e. proceed), yellow (i.e., proceed and prepare to stop at the next signal) and red (i.e., stop and then proceed with caution at restricted speed). The three aspect signal case 10 is divided into three individual lens compartments 22, 24, 26. In particular, the front wall. 12 and the door 20 when in its closed or operative position form a space therebetween. A first compartment 22 is defined in that space between the top wall 16 and the first or top interior wall 18. A second compartment 24 is defined in that space between the first and the second or lower interior wall 18, while a third compartment 26 is defined in that space between the second interior wall 18 and the bottom wall 17.

The use of the individual lens compartments ensures accurate indications by minimizing the occurrence of phantom indications and also increases the mechanical strength of the case.

Should the case 10 need to be for example a four color light signal, the number of interior walls 18 will increase to three in order to form four compartments. Conversely, should the case 10 need to be for a two color light signal, the number of interior walls 18 will decrease to one so that two compartments are formed.

Figure 5:
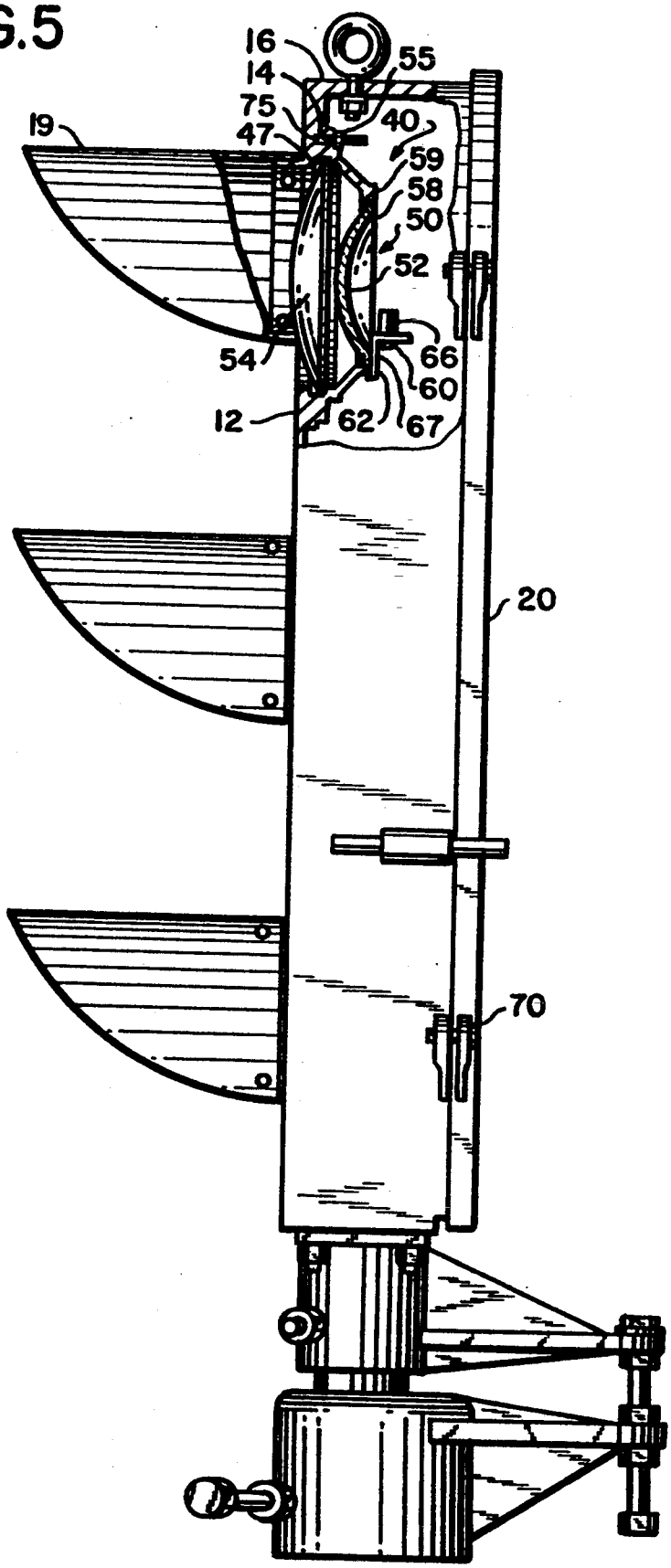
FIG. 5 is a side view of the light signal case of FIG. 1.

As discussed below, the precise aspect to aspect alignment is achieved by the positioning of the lens mount 40 on the inside surface of the case 10 as shown in FIG. 5.

Referring to FIG. 3, the inside of the front wall 12 of the case 10 has a surface 14 that is machined finished. There is also provided three circular areas 11 each for mounting therein a threaded stud or screw 75 one of which is shown in FIG. 5.

Figure 4:
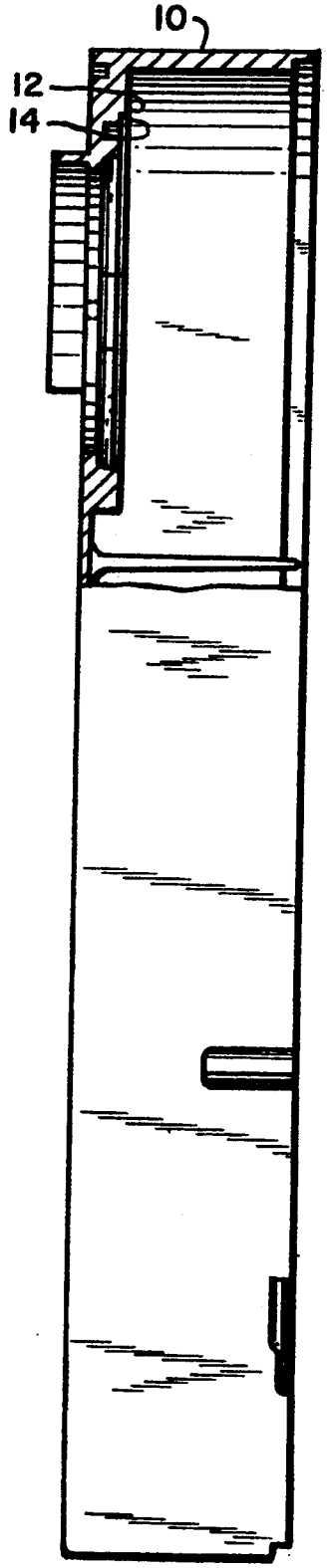
FIG. 4 is a side elevation view broken away from a compartment of the light signal of FIG. 1.

Referring to FIG. 4, machined surface 14 of the front wall is a continuous machined cylindrical shape. These surfaces 14 form a virtually horizontal plane so that the outer lens can rest thereon. Each surface 14 can be slightly biased with respect to front wall 12, however, surfaces 14 of each respective compartment must be parallel, e.g., horizontal, with respect to each other so as to form an almost perfect plane. Accordingly, the tolerance permitted for each of the areas is only $0.005 \pm 0.001$.

Figure 6:
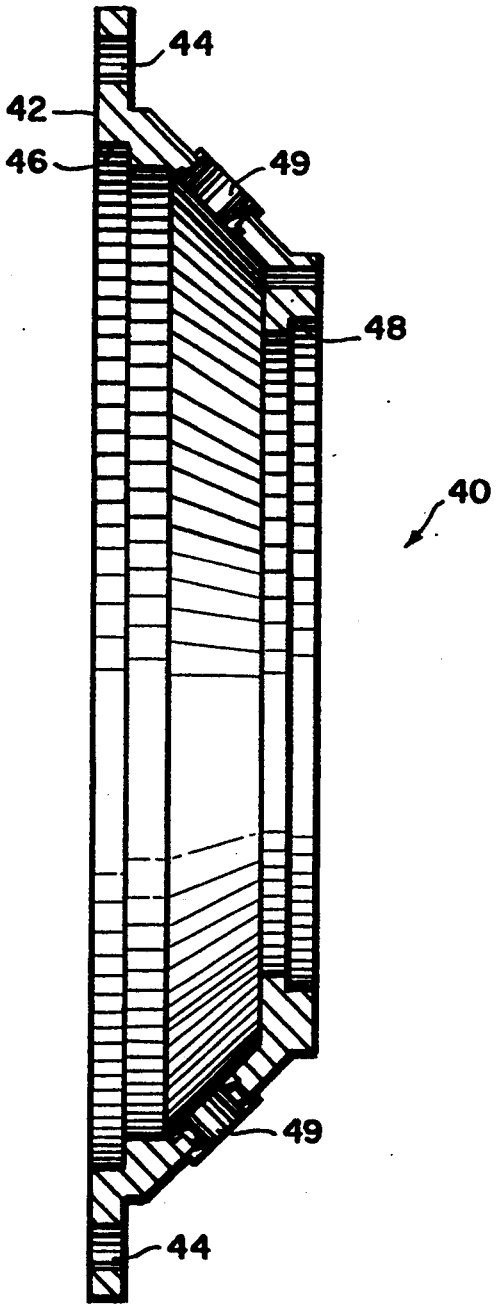
FIG. 6 is an exploded front view of the lens mount used in the compartment shown in FIG. 5.

As shown in FIGS. 5 and 6, the preferred lens mount or bezel 40 has basically a funnel shape. The lens bezel 40 has a circumferential flange portion 42 with a plurality of holes 44 therethrough and a circumferential step or seat 46 formed at the flange portion. The circumferential seats 46 and 48 are designed to accommodate the circumference of the lens. The opposite or reduced end of the funnel shaped lens bezel 40 has a circumferential lip or seat 48. The lens bezel 40 also preferably includes ventilators 49 to permit for the movement of air.

In the preferred embodiment, the bezel 40 is made of cast aluminum. In addition, the screws 75 are preferably made of zinc chromate steel.

The signal light has a replaceable lens unit 50 that is removably mounted in each lens bezel 40. A back plate 58 is connected to the reduced end of each lens bezel 40 by conventional means, such as, for example, threaded screws 59. Alternatively, inner lens 52 may be retained by means of clips and screws, not shown, without the need for any back plate.

The lens unit 50 is, preferably, a doublet lens systems that preferably consists of a five and one half inch inner lens 52 and an eight and three eight's inch outer lens 54. The inner lens is preferably retained by clips and screws to the smaller portion of the lens mount, i.e., that portion of the lens mount facing the rear of the case. The outer lens is secured between the lens mount and the machined surface of the front wall. It is preferred that the inner lens 52 be a glass colored lens to minimize color dilution over time. It is also preferred that the outer lens 54 be made of polycarbonate in order to maximize impact resistance.

As shown in FIG. 5, lens mount or bezel 40 is removably secured to the machined inside surface 14 of front wall 12. Case 10 preferably has a plurality of threaded screws or studs 75 (only one of which is shown) mounted in holes 11 that project inside the case and are adapted to receive the plurality of holes 44 of lens bezel 40. In the most preferred embodiment, three studs 75 and three holes 44 are provided to securely mount lens bezel 40 to the studs in holes 11 of the machined inside surface 14 of case 10. Each hole 44 is adapted to slide on one threaded screw 75 and be secured thereto by one threaded nut 55. Significantly, in a multiple aspect light signal, the mounting of each lens bezel 40 with its lens unit 50 therein on the machined inside surface 14 of the case 10 achieves precise aspect to aspect alignment of the aspects in the light signal 1. If only one aspect is provided in the light signal that aspect, nonetheless, would be in proper alignment.

The lens unit 50 is mounted to the inside surface of the case 10 as follows. The outer lens 54 is positioned at the circumferential step 46 of the lens bezel 40. The inner lens 52 is secured between the circumferential lip 48 and the back plate 58. Thus, the step 46 and the lip 48 form mounting surfaces or rings in the bezel to position the lens unit 50. The lens bezel 40 is then aligned against the machined surface 14 of the case 10 by sliding the apertures 44 of the lens bezel 40 on the studs 75. The nuts 55 are then placed on the studs 75 and screwed or tightened thereon to secure the lens bezel 40 to the case 10.

A gasket 47 is provided between the case 10 and the peripheral portion of the lens bezel 40 to prevent water from seeping into the case 10. The gasket is, preferably, a conventional neoprene gasket.

An L-shape bracket 62, preferably made of a non-conductive plastic material, is mounted on the lens bezel 40 by conventional means, such as, for example, a pair of screws 67. A lamp receptacle 60 is mounted to the bracket 62. The receptacle 60 is electrically connected, by conventional means, such as, for example, standard electrical wiring to an electric source (not shown). As shown in FIG. 3, the electrical wiring 64 passes through holes or notches 15, shown in FIG. 2, in the interior walls 18 to connect electrically the lamp receptacles 60 of each compartment.

The positioning of the bracket 62 on the lens bezel 40 is significant since it places the lamp receptacle 60 in such proximity to the lens unit 50 in the lens bezel 40 that there is no need to focus or re-focus the aspect of the light signal. As shown in FIGS. 2 and 5, the L-shape bracket 62 has one leg of the L-shape abuts the lower portion of the lip 48 of the lens bezel 40 and the back plate 58, and the other leg is parallel to the inside surface of the top wall 16 of the case 10. Accordingly, the lamp 66 almost abuts the inner lens 52 and is in a horizontal plane that includes the lens unit 50 and the aperture 13 through the front wall 12. Thus, it has been found that this positioning of the bracket 62 with respect to the lens bezel 40 and the lens unit 50 therein provides a fixed focus for the light signal.

The receptacle 60 is constructed to operatively receive a single-contact, candelabra, two pin bayonet base lamp 66. The lamp 66 is field replaceable.

A maintenance worker or maintainer has ready access to the back of the lens bezel 40 in each compartment by simply releasing the screws 70 and opening the door 20. Each lens unit 50 (i.e., lens unit 50 comprises an inner lens 52 and an outer lens 54) can then be readily removed from the case 10 by simply removing nuts 55 and then sliding the lens bezel 40 off of the screws 75. The old lenses 52, 54 can be removed and new lenses can be installed in the lens bezel 40, as discussed above, and then the holes 44 of the lens bezel can be slid onto the studs 75. The lens bezel 40 is then secured tightly against the machined inside surface 14 be tightening the nuts 55 on the studs 75. The relative positioning of the bracket 62 to the lens bezel 40 provides for the automatic fixed focusing of the new lens unit 50. In addition, the relation of the machined surface 14 and the lens bezel 40 provides for the aspect to aspect alignment in a multiple aspect light signal.

Thus, the color light signal 1 provides a case 10 that has a compartment per lens unit 50 or color light and, moreover, provides for rear entry into the case. The rear entry permits the ready and easy replacement of an old lens unit 50 with a new, lens unit absent the need for focusing and aspect alignment.

Figure 7:
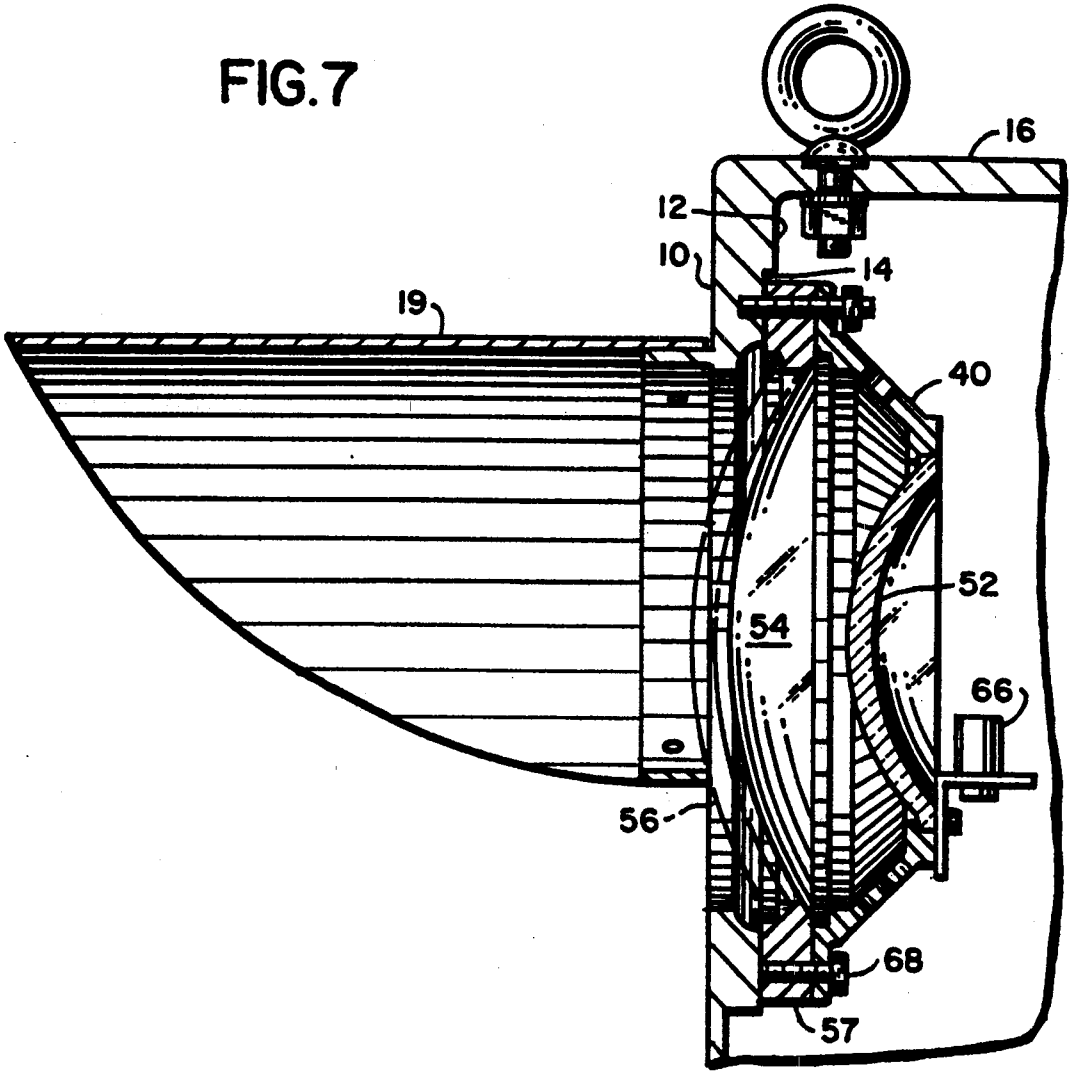
FIG. 7 is a side view of an alternative embodiment of a lens unit and lens mount used in the light signal of FIG. 1.

FIG. 7 is an alternative embodiment of the lens mounting 40 and lens unit 50. An optional lens 56 is provided. An adapter or ring 57 is also provided to secure in place the optional lens 56. The adapter 57 is secured between the lens bezel 40 and the inside surface 14 of the case 10 so that the lens mounting consists of the lens bezel and the adapter. The adapter 57 has a plurality of holes that are adapted to fit on screws 75 and, in addition, for this embodiment a screw 68 is used to secure the lens bezel 40 to the adapter 57.

Having thus described the invention with particular references to the preferred forms thereof, it will be obvious that various changes and modifications may be made therein without departing from the spirit and scope of the invention as defined by the appended claims.

What is claimed is:

1. A rear access, railway light signal which comprises:

a housing including an immovable front wall having at least one aperture and an inside and outside surface, and having a rear wall with a rear door, said rear door being movable from a first, closed position that prohibits access to the interior of said housing to a second, open position that permits access to the interior of said housing;

a complete lens unit having an inner lens and an outer lens;

means for removing said complete lens unit rearwardly from a normal, operable position in the interior of said housing to a second, non-operable position but only when said rear door is in said second, open position;

said means for removing including at least one funnel-shaped lens mount for receiving said inner lens and outer lens unit, said lens mount having an integral ring-shaped flange at its outer front periphery for normally abutting the inside surface of said immovable front wall and surrounding said at least one aperture; and means for removably securing said lens mount at said inside surface of said immovable front wall, whereby the complete lens unit is fully serviceable and replaceable without affecting the front of said light signal; and at least one light mean secured to the rear of said lens mount.

2. A light signal as defined in claim 1, further including one fixed focusing means having a receptacle for operative receipt of said light means, said fixed focusing means being positioned at the end of said lens mount nearest said inner lens, whereby the focus of said light means is fixed relative to said lens unit.

3. The light signal according to claim 1, wherein said lens mount is a lens bezel which has a seat formed for receipt of said outer lens and a lip for receipt of said inner lens.

4. The light signal according to claim 1, wherein said means for securing said lens mount to said inside surface of said front wall is a plurality of studs projecting from said front wall about each aperture and holes disposed within said flange portion of said lens mount to receive said studs.

5. The light signal according to claim 1, wherein the inside surface of said front wall is a machined surface.

6. The light signal according to claim 5, wherein said machined surface has a tolerance of about $0.005 \pm 0.001$ from the horizontal plane.

* * * * *